US005873950A

United States Patent [19]

Ganesan et al.

[11] Patent Number: 5,873,950

[45] Date of Patent: Feb. 23, 1999

[54] STRENGTHENABLE ETHYLENE PYROLYSIS ALLOY

[75] Inventors: Pasupathy Ganesan; Gaylord Darrell Smith, both of Huntington, W. Va.; Charles R. Conder, Proctorville, Ohio

[73] Assignee: Inco Alloys International, Inc., Huntington, W. Va.

[21] Appl. No.: 663,511

[22] Filed: Jun. 13, 1996

[51] Int. Cl.[6] ..... C23C 8/20; C23C 8/22

[52] U.S. Cl. ..... 148/206; 148/316; 148/319; 428/627; 201/13; 48/4

[58] Field of Search ..... 148/419, 442, 148/319, 316, 206; 428/627; 420/584.1, 586, 586.1; 201/13; 48/4

[56] References Cited

U.S. PATENT DOCUMENTS

| | | | |
|---|---|---|---|
| 2,900,250 | 8/1959 | Metcalfe | 420/584.1 |
| 3,865,581 | 2/1975 | Sekino et al. | 420/584.1 |
| 3,865,634 | 2/1975 | Bagnoli et al. . | |
| 3,919,073 | 11/1975 | Bagnoli et al. | 208/47 |
| 4,443,406 | 4/1984 | Sukekawa et al. | 420/586 |
| 4,530,720 | 7/1985 | Moroishi et al. | 420/584.1 |
| 5,021,215 | 6/1991 | Sawaragi et al. | 420/584.1 |

FOREIGN PATENT DOCUMENTS

| | | | |
|---|---|---|---|
| 51-013310 | 2/1976 | Japan | 420/584.1 |
| 57-023050 | 2/1982 | Japan . | |
| 58-073751 | 5/1983 | Japan | 420/584.1 |
| 58-073752 | 5/1983 | Japan | 420/584.1 |
| 58-210142 | 12/1983 | Japan | 420/584.1 |
| 59-060101 | 4/1984 | Japan | 420/584.1 |

*Primary Examiner*—Margery Phipps
*Attorney, Agent, or Firm*—Edward A. Steen

[57] ABSTRACT

There is provided a nickel-base alloy with service enhanced strengthening properties. When exposed to ethylene pyrolysis conditions, namely a carbon containing environment and at temperatures of at least about 900° C., the alloy forms $M_6C$ and MC carbides that strengthen the alloy. The alloy may be formed into internally finned tubing.

The alloy includes about 0.08–0.11% carbon, 41–45% nickel, 23–26% chromium, 0.6–0.95% manganese, 1–1.7% silicon, 0.2–0.6% titanium, 0.25–0.55% aluminum, 1.3–1.7% molybdenum, 0.25–0.6% niobium, 0.15–0.45% tantalum, 0–0.2% tungsten, 0.001–0.005% boron, 0.01–0.03% zirconium, and the balance iron with trace commercial impurities.

16 Claims, 3 Drawing Sheets

STRENGTHENABLE ETHYLENE PYROLYSIS ALLOY

TECHNICAL FIELD

The instant alloy relates to nickel-base alloys in general and, more particularly, to an alloy especially useful for ethylene pyrolysis applications.

BACKGROUND ART

Ethylene pyrolysis involves the cracking of hydrocarbons and steam mixtures in a furnace to produce ethylene, a basic raw material used in the polymer and synthetic fiber industries. The process is usually carried out in tube coils heated to about 800°–1000° C.

Currently, cast alloy HK40 or wrought alloy 800 tubes are used. A recent trend in the industry is to improve throughput by increasing temperatures and decreasing the residence time. These demands call for an alloy having improved creep strength and carburization resistance to about 1100° C.

It is also useful to employ internally finned tubes to increase the surface area of the piping. This technique further increases the efficiency of the pyrolysis process.

Current alloys tend to coke in certain cases. Decoking procedures require expensive down time.

There have been attempts to develop and/or adapt alloys for ethylene pyrolysis service. Alloys HK40, HPM and the 800 series have met with varying degrees of success.

The problem appears to be that the alloys carburize in service primary as a result of coking.

There is a need for an alloy especially adapted for ethylene pyrolysis operations.

SUMMARY OF THE INVENTION

Accordingly, there is provided a composition of matter with improved properties that result in superior performance in ethylene pyrolysis service. The focus of these efforts is on (1) enhancing carburization resistance while reducing the tendency to coke, (2) providing adequate oxidation resistance for the outside diameter of the tubing enabling higher temperature exposure (about 1038° C. to 1149° C.), and (3) improved creep and stress rupture properties to ensure adequate life (a minimum of about 50,000 hours) while not embrittling the alloy due to deleterious phases. Moreover, the alloy is amenable to internally finned tubing fabrication.

PREFERRED MODE FOR CARRYING OUT THE INVENTION

Figure 1:
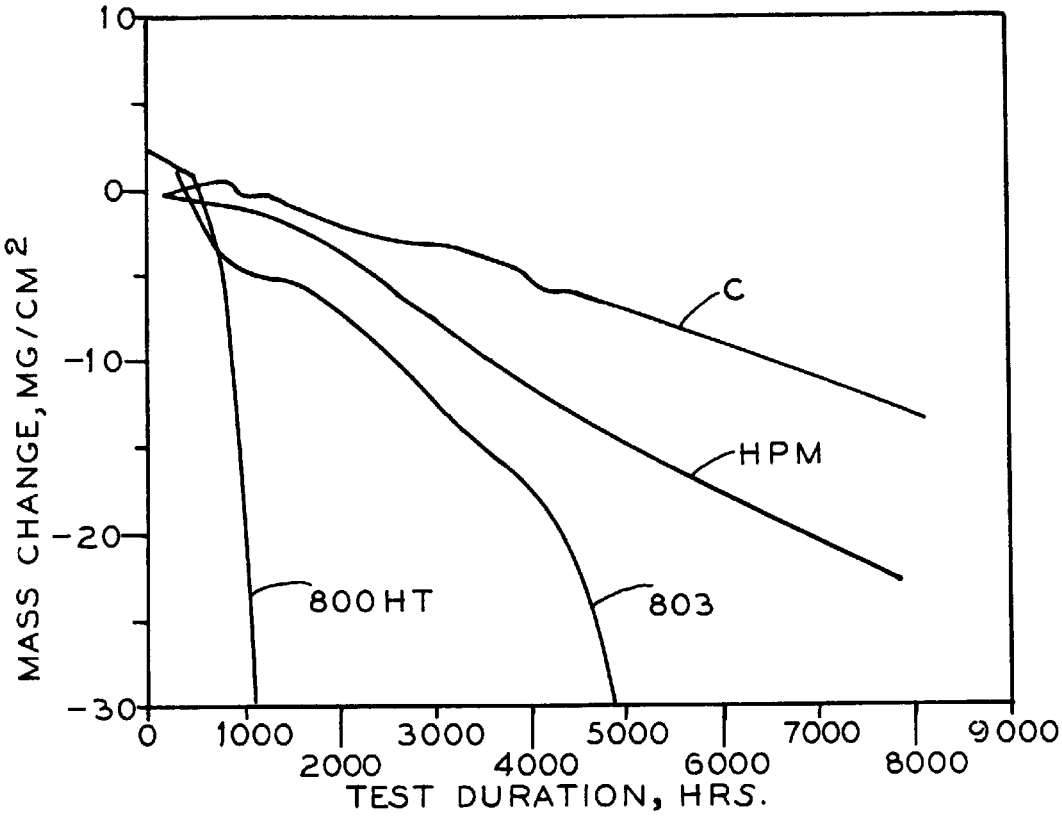
FIG. 1 is an oxidation test graph at 1000° C.

The instant invention includes in weight percent about 0.06–0.14%C, about 35–46%Ni, about 22.5–26.5%Cr, about 0–1.5%Mn, about 0.5–2% Si, about 0.1–1%Ti, about 0.05–2%Al, about 1–3%Mo, about 0.2–1%Nb, about 0.1–1%Ta, about 0–0.3%W, about 0–0.008%B, 0–0.05%Zr, and the balance essentially Fe with typical amounts of commercial trace and tramp elements.

For the purpose of this specification, the adjective "about" before at least one member of a series shall be construed to apply to every following member of that series.

The alloy is designed to be electric furnace melted, Argon-Oxygen-Decarburization (AOD) refined, and teemed into ingots suitable for preparation by forging or hot rolling into extrusion billets. Importantly, the alloy is capable of being cold-worked into tubing with internal fins. Such internal geometries are essential for rapid heat transfer in modern high velocity ethylene pyrolysis production furnaces. Finally, field fabrication of the furnace requires a degree of weldability and repairability.

The resultant alloy possesses superior carburization resistance as compared to current commercial ethylene pyrolysis alloys such as INCOLOY® alloy 800HT®, 803, HK40 and HPM. (INCOLOY and 800HT are trademarks of the Inco family of companies).

For ease of comparison, Table 1 below shows the approximate compositions (in weight per cent) of some of the currently available ethylene pyrolysis alloys.

TABLE 1

| | HPM | 803 | 800HT ® | HK40 |
|---|---|---|---|---|
| % C | 0.12 | 0.09 | 0.08 | 0.4 |
| % Mn | 1.11 | 0.87 | — | 1.5 |
| % Fe | 32 | 35.2 | 46 | 56.35 |
| % S | <0.03 | 0.0002 | — | — |
| % Si | 1.83 | 0.66 | <1.00 | 1.75 |
| % Ni | 38 | 35.91 | 32.5 | 15 |
| % Cr | 24.4 | 25.61 | 21.0 | 25 |
| % A1 | 0.02 | 0.57 | 1.0 | — |
| % Ti | 0.5 | 0.56 | — | — |
| % Co | — | 0.07 | — | — |
| % Mo | 1.43 | 0.07 | — | — |
| % Nb | 0.01 | 0.37 | — | — |
| % P | <0.02 | 0.016 | — | — |
| % Ta | — | 0.003 | — | — |
| % W | — | 0.035 | — | — |
| % B | — | 0.0013 | — | — |
| % Cu | — | <0.75 | — | — |

In addition, and apparently critical in concept, is the discovery that the instant alloy range defined above is uniquely capable of enhancing its already superior stress rupture strength by exposure to the ethylene pyrolysis environment. As far as is known, no other alloy range is capable of this effect to the degree exhibited by the instant alloy. Other ethylene pyrolysis alloys are improperly formulated to exploit this discovery to the fullest in the temperature range of interest (1038° C. to 1149° C.) and in the ethylene pyrolysis environment. The phenomenon of service enhanced strengthening ("SES") results from a judiciously balanced addition of refractory metal elements (Mo, Nb, W and Ta) that form $M_6C$ and MC carbides at the anticipated service temperatures (1038° C. to 1149° C.) thereby inhibiting dislocation creep and grain boundary sliding that result in alloy creep and ultimately to stress rupture failure.

The carbon range is critical. To ensure satisfactory finned tube manufacture, the carbon content should not exceed about 0.14% to assure adequate room temperature ductility and optimally less than about 0.12%C. On the other hand, a minimum high temperature strength is required to sustain the dimensional stability (creep resistance) of the alloy while the strength is being enhanced by the carboneous environment. This is achieved by a minimum carbon level of about 0.06%. The carbon level is optimally defined by the range of about 0.06%–0.12% carbon by the fact that it has been discovered that a conventional final anneal temperature range of about 1177° C. to 1232° C. will grow the grain size to the ASTM grain size range of #4 to #2 which is ideally sought for enhancing both stress rupture strength and thermal fatigue resistance. Since refractory elements contribute substantially to solid solution strengthening, accelerated work hardening rates and the formation of embrittling phases, these elements should be controlled to narrow ranges to accomplish SES accelerated work hardening rates and the formation of embrittling phases while not compromising finned tube manufacture, weldability and alloy embrittlement which reduces thermal fatigue resistance. If the carbon/refractory metal element ranges are maintained within the limits of this invention, substantial ductility is retained in the alloy which enhances thermal shock resistance and repairability.

In this regard, Cr content is also critical. Alloys containing greater than about 26.5%Cr may form sigma phase depending on composition and environmental conditions making repairability impossible. Conversely about 22.5%Cr is critical for development of a dense, adherent chromia ($Cr_2O_3$) scale which provides the alloy with superior oxidation and carburization resistance and minimizes the tendency for coking. Chromium will react with carbon to form chromium-rich $M_{23}C_6$ in high nickel austenitic alloys (examples of which include INCOLOY® alloys 800HT® and 803, HK40, and HPM.) This carbide tends to be stable between about 540° C. and 900° C. and will contribute to strength of the alloy in this temperature range as the quantity increases over time either due to precipitation of indigenous carbon or due to carbon ingress from the ethylene pyrolysis atmosphere. However, as the size of the carbide precipitates increases, their contribution to elevated temperature strength decreases. Above about 900° C., this carbide is not stable and redissolves in the matrix or transforms into other phases through reactions with the matrix. Hence, this carbide is unsatisfactory for long term strengthening above about 900° C.

Carbides of the $M_6C$ and MC type which form from the refractory elements, Mo, W, Nb and Ta, are stable above about 900° C. and are relatively resistant to particle coarsening. These carbides, formed on dislocations voids, twin and slip lines and grain boundaries, exert a threshold stress on moving dislocations that retard creep and ultimately stress rupture failure. It is the concept of this invention that carbon ingress from the ethylene pyrolysis atmosphere will progressively react at service temperatures with the refractory element reservoir of the alloy to form stable $M_6C$ and $M_{23}C_6$ (which may convert to $M_7C_3$) carbides which result in SES.

The Si content of the alloy forms a subscale silica ($SiO_2$) layer which aids in retarding carbon ingress thereby resulting in slow, steady SES over an extended period while making repairability a possibility over this same period. Greater than about 2.0%Si can have the effect of reducing as-annealed ductility, fabricability and repairability without significantly improving carburization and oxidation resistance.

Mn levels to about 1.0% aid sulfidation resistance and weldability. However, it is noted that gradually increasing levels of Mn have an increasing tendency to reduce oxidation resistance. Therefore, the maximum Mn level is restricted to about 1.0%.

A preferred intermediate range alloy includes about 0.07–0.12% carbon 38–45% nickel, 23–26% chromium, 0.5–1% manganese, 0.8–2% silicon, 0.2–1% aluminum, 1–2% molybdenum, 0.2–0.8% niobium, 0.15–0.6% tantalum, 0–0.25% tungsten, 0–0.006% boron, 0.005–0.04% zirconium, and the balance iron.

A preferred narrow range alloy includes about 0.08–0.11% carbon, 41–44% nickel, 24–26% chromium, 0.6–0.9% manganese, 1–1.7% silicon, 0.2–0.6% titanium, 0.25–0.55% aluminum, 1.3–1.7% molybdenum, 0.25–0.6% niobium, 0.15–0.45% tantalum, 0–0.2% tungsten, 0.001–0.005% boron, 0.01–0.03% zirconium, and the balance iron.

A number of experimental heats were made to test the efficacy of the invention.

EXAMPLE 1

An alloy including about 0.11%C, 0.02% Mn, 1.8%Si, 0.28% Ti, 0.21%Al, 44%Ni; 26.2%Cr, 1.5Mo, 0.4%Nb, 0.22%Ta, 0.009%Zr, 0.005%B, balance Fe was cast, hot and cold worked to 0.635 cm (0.25 inch) thick flats and annealed at 1204° C. for thirty minutes and water quenched. The stress rupture properties at 980° C./20.68 MPa are as follows:

| As-Annealed | |
|---|---|
| Rupture Life Hours | Elongation (%) |
| 742 | 37 |

EXAMPLE 2

An alloy within the optimum carbon range (about 0.06%–0.12%) is given by the composition including about 0.082%C, 0.015%Mn, 1.51%Si, 44.16%Ni, 25.22%Cr, 0.45%Ti, 0.13%Al, 1.54%Mo, 0.396%Nb, 0.21%Ta, 0.0037%B, balance Fe, was cast, hot and cold worked to 0.635 cm (0.25 inch) thick flats and annealed at 1121° C./20 minutes followed by 1232° C./30 minutes and water quenched. The stress rupture properties at 980° C./20.68 MPa are as follows:

| As-Annealed | | After 300 Hours at 1000° C. in $H_2$-1% $CH_4$ | |
|---|---|---|---|
| Rupture Life (hours) | Elongation (%) | Rupture Life (Hours) | Elongation (%) |
| 1253 | 45 | 3696 | 40 |
| | | 3748 | 38 |

Note the retention of ductility despite the three-fold increase in life.

EXAMPLE 3

A further example of an alloy within the optimum carbon range (about 0.06–0.12%) is given by the composition including about 0.061%C, 0.295%Mn, 1.53%Si, 44.13%Ni, 25.18%Cr, 0.46%Ti, 0.12%Al, 1.54%Mo, 0.391%Nb, 0.23%Ta, 0.0026%B, balance Fe, which was cast, hot and cold worked to 0.635 cm (0.25 inch) flats and annealed at 1232° C./30 minutes and water quenched. The stress rupture properties at 980° C./20.68 MPa are as follows:

| As-Annealed | | After 300 Hours at 1000° C. in $H_2$-1% $CH_4$ | |
|---|---|---|---|
| Rupture Life (Hours) | Elongation (%) | Rupture Life (Hours) | Elongation (%) |
| 763 | 48 | 2303 | 45 |

-continued

| As-Annealed | | After 300 Hours at 1000° C. in $H_2$-1% $CH_4$ | |
|---|---|---|---|
| Rupture Life (Hours) | Elongation (%) | Rupture Life (Hours) | Elongation (%) |
| | | 2875 | 37 |

EXAMPLE 4

Because wrought alloy tubing for steam methane reforming is of interest as well as tubing for ethylene pyrolysis, a heat within the optimum carbon range (about 0.06–0.12%) having the composition of about 0.104%C, 0.301%Mn, 1.96%Si, 43.96%Ni, 25.12%Cr, 0.44%Ti, 0.12%Al, 1.53%Mo, 0.387%Nb, 0.23%Ta, 0.003%W, 0.0029%B, balance Fe was cast, hot and cold worked to 0.635 cm (0.25 inch) flats and annealed at 1232° C./30 minutes and water quenched. The stress rupture properties for this heat are as follows:

| As Annealed 980° C./20.68 MPa | | After 300 Hours at 1000° C. in $H_2$-1% $CH_4$ 980° C./20.68 MPa | |
|---|---|---|---|
| Rupture Life (Hours) | Elongation (%) | Rupture Life (Hours) | Elongation (%) |
| 670 | — | 3733 | 47 |

| After 300 Hours at 1000° C. in $H_2$-5.5% $CH_4$-4.5% $CO_2$ 980° C./20.68 MPa | |
|---|---|
| Rupture Life (Hours) | Elongation (%) |
| 1706 | 33 |

Note the greater improvement in stress rupture life associated with the atmosphere with the greater rate of carbon ingress into the test specimen. The $H_2$—5.5%$CH_4$—4.5%$CO_2$ atmosphere mimics a typical steam methane reforming atmosphere with respect to its carbon and oxygen potentials.

| As Annealed 1093° C./10.34 MPa | | After 300 Hours at 1000° C. in $H_2$-1% $CH_4$ 1093° C./10.34 MPa | |
|---|---|---|---|
| Rupture Life (Hours) | Elongation (%) | Rupture Life (Hours) | Elongation (%) |
| 145 | 32 | 4541 | 10 |

| After 300 Hours at 1000° C. in $H_2$-5.5% $CH_4$-4.5% $CO_2$ 1093° C./10.34 MPa | |
|---|---|
| Rupture Life (Hours) | Elongation (%) |
| 765 | 56 |

Note that the effect of atmosphere is again evident.

EXAMPLE 5

As an example of a composition that fails to respond to SES, the following composition 0.081%C, 0.88%Mn, 0.70%Si, 35.13%Ni, 25.5%Cr, 0.60%Ti, 0.57%Al, 0.07%Mo, 0.07%Nb, <0.01%Ta, 0.0005%B, balance Fe was cast, hot and cold worked to 0.635cm (0.25 inch) flats and annealed at 1232° C./30 minutes and water quenched. The stress rupture properties are as follows:

| As-Annealed 980° C./20.68 MPa | | After 300 Hours ate 1000° C. in $H_2$-5.5% $CH_4$-4.5% $CO_2$ 980° C./20.68 MPa | |
|---|---|---|---|
| Rupture Life (Hours) | Elongation (%) | Rupture Life (Hours) | Elongation (%) |
| 357 | 30 | 206 | 80 |
| | | 190 | 83 |

| As-Annealed 1093° C./10.34 MPa | | After 300 Hours at 1000° C. in $H_2$-5.5% $CH_4$-4.5% $CO_2$ 1093° C./10.34 MPa | |
|---|---|---|---|
| Rupture Life (Hours) | Elongation (%) | Rupture Life (Hours) | Elongation (%) |
| 142 | 54 | 137 | 86 |
| | | 221 | 97 |

To further test the viability of the instant invention, oxidation and carburization resistance tests were run on a series of heats made in accordance with the instant invention.

Table 2 shows the composition of additional heats A, B, C and D in weight percent which are within the range of the invention.

Figure 2:
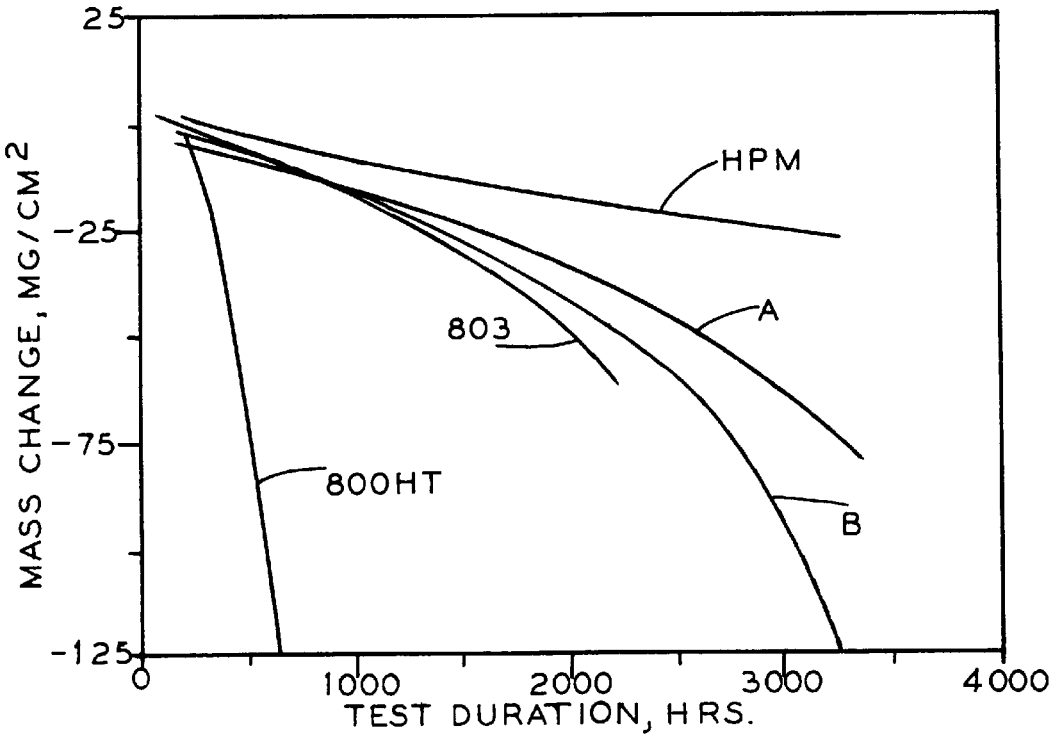
FIG. 2 is an oxidation test graph at 1100° C.

FIGS. 1 and 2 illustrate the oxidation resistance in an atmosphere consisting of air +5% water vapor at 1000° C. and 1100° C., respectively. Alloys 800HT, 803 and HPM are from currently produced compositions. The results of the oxidation test at 1000° C. and 1100° C. reveal that the instant alloy is satisfactory for ethylene production.

TABLE 2

| ADDITIONAL HEATS | | | | |
|---|---|---|---|---|
| | A | B | C | D |
| % C | 0.082 | 0.082 | 0.114 | 0.086 |
| % Mn | 0.015 | 0.299 | 0.061 | 0.22 |
| % Fe | 26.23 | 25.77 | 26.08 | 29.93 |
| % S | 0.0007 | 0.0009 | 0.0006 | 0.001 |
| % Si | 1.51 | 1.97 | 1.81 | 1.62 |
| % Ni | 44.16 | 43.90 | 44.01 | 41.56 |
| % Cr | 25.22 | 25.14 | 25.13 | 23.63 |
| % Al | 0.13 | 0.12 | 0.055 | 0.11 |
| % Ti | 0.45 | 0.45 | 0.501 | 0.41 |
| % Co | 0.0023 | 0.0040 | 0.0065 | 0.05 |
| % Mo | 1.54 | 1.53 | 1.46 | 1.43 |
| % B | 0.0037 | 0.0026 | 0.0024 | <0.001 |
| % Nb | 0.396 | 0.392 | 0.387 | 0.37 |
| % P | 0.0001 | 0.0003 | 0.0007 | 0.014 |
| % Ta | 0.21 | 0.23 | 0.22 | 0.25 |
| % W | 0.003 | 0.003 | 0.004 | 0.11 |

Figure 3:
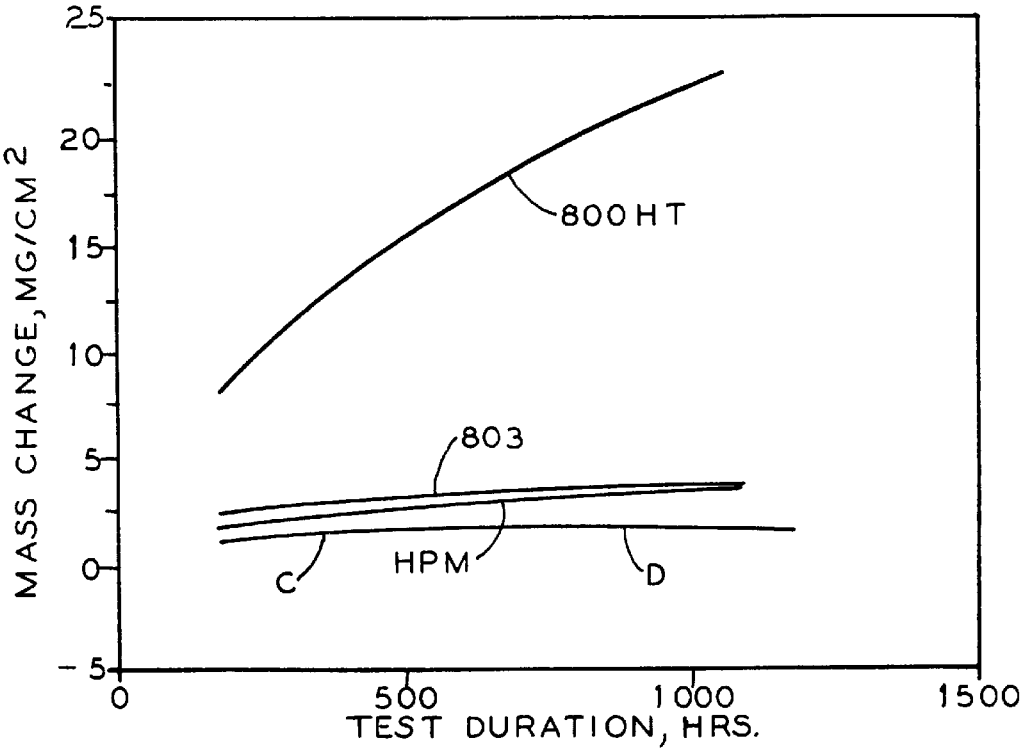
FIG. 3 is a carburization test graph at 1000° C.
Figure 4:
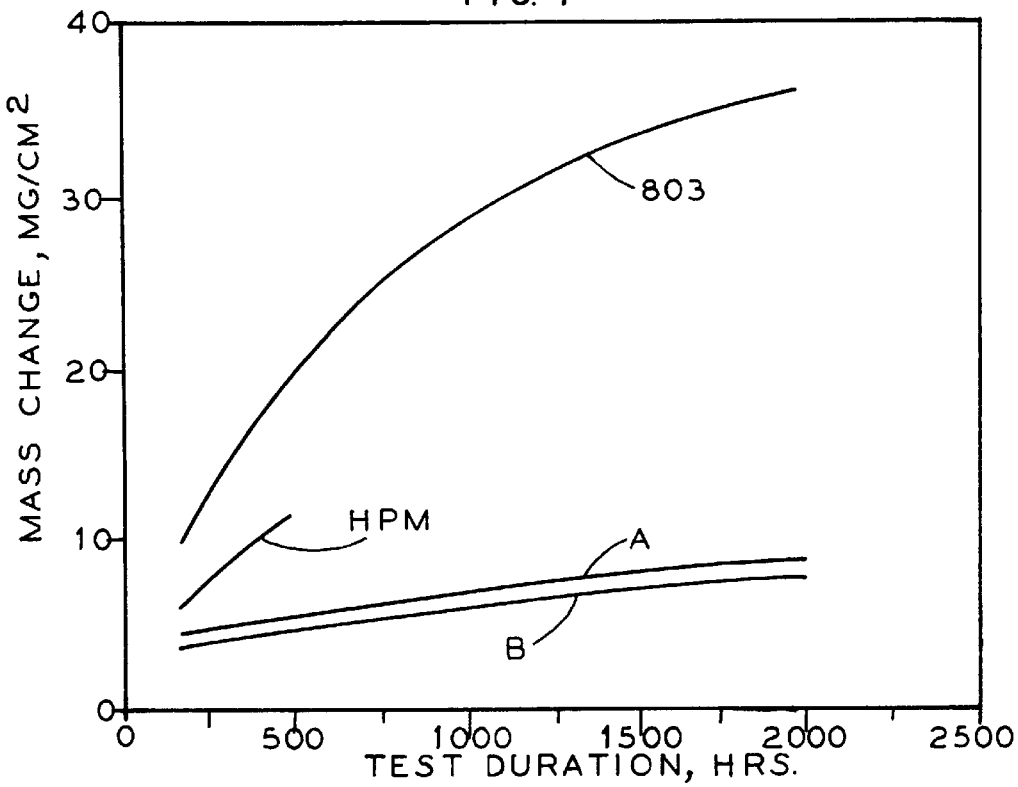
FIG. 4 is a carburization that graph at 1100° C.

The carburization tests in an atmosphere consisting of $H_2$—5.5%$CH_4$—4.5%$CO_2$ at 1000° C. and 1100° C. are shown in FIGS. 3 and 4 respectively. This carburizing atmosphere best simulates an ethylene pyrolysis environment. The carburization data for the instant alloy exhibits a small mass change for each test temperature. This small mass gain suggests that the service life of the instant alloy will be longer due to the fact that HPM alloy and alloy 803, at the higher temperature, will be saturated with carbon in a shorter time allowing these alloys to become brittle, ultimately leading to failure.

Figure 5:
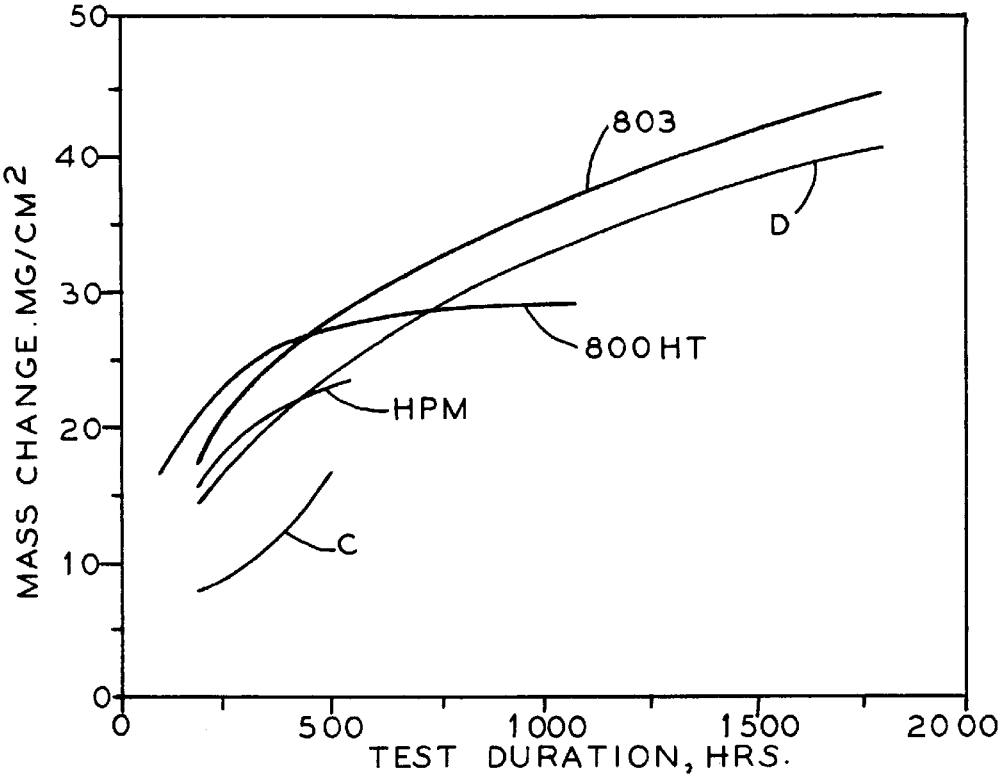
FIG. 5 is a carburization test graph at 1000° C.
Figure 6:
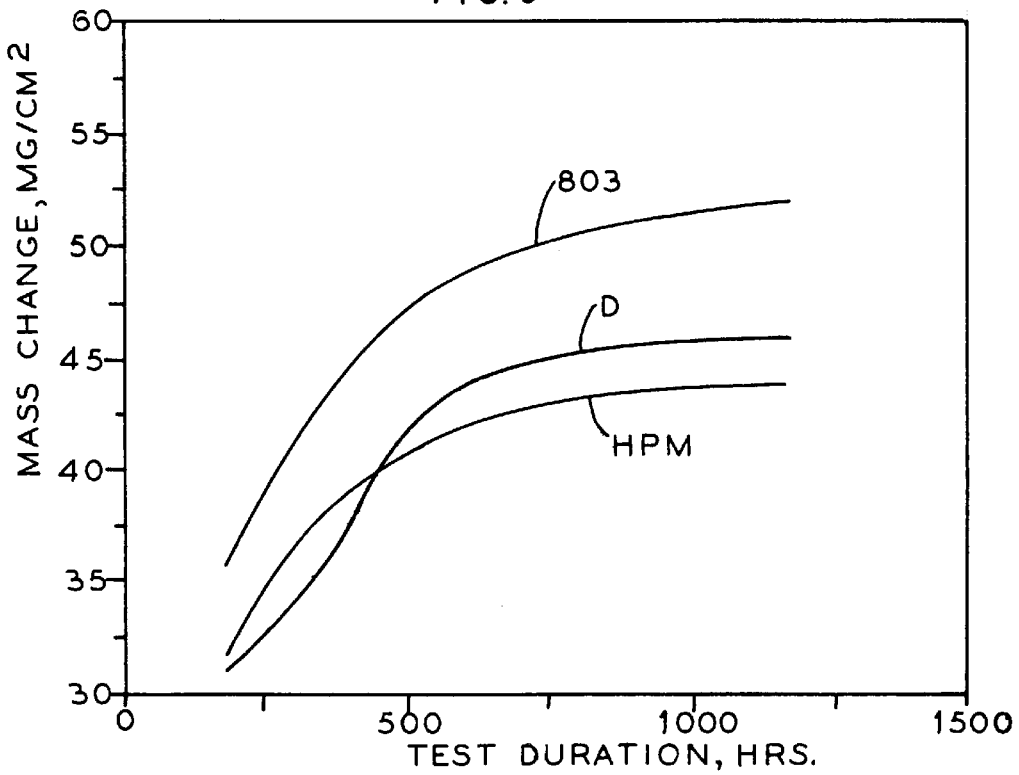
FIG. 6 is a carburization test graph at 1100° C.

In a more severe carburizing atmosphere consisting of $H_2$—1%$CH_4$ the mass change is approximately the same between the instant alloy and alloy HPM at 1000° C. and 1100° C. See FIGS. 5 and 6.

However, the more severe reducing carburizing atmosphere ($H_2$—1%$CH_4$) is not the best replication of the ethylene pyrolysis environment that the alloys will see in service. The previously discussed carburizing/oxidizing environment ($H_2$—5.5%$CH_4$—4.5%$CO_2$) is a more realistic test environment, since there will be a relative amount of oxygen present to produce a protective oxide scale which will enhance the carburization resistance. But it demonstrates the usefulness of the alloy.

Heats A, B and C were processed by vacuum induction melting and hot rolling to 1.55 cm (⅝) rods. Heat D was a production heat that was AOD melted to extrusion billets and tube-reduced to a standard ethylene 7 cm (2.75") OD straight fin tube. Heat D was also produced to a 1.0 cm (¾) thick plate.

It is evident that the new alloy exhibits a preferred corrosion resistance for ethylene pryolysis service. The data clearly supports this finding as indicated in the figures. The data demonstrate that the strength capabilities are superior to that of other ethylene pyrolysis alloys.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follow:

1. A service strengthened cold workable nickel-base alloy wherein strengthening occurs in excess of at least about 900° C. in a carbon containing environment, the alloy consisting essentially of about 0.08–0.11% carbon, 41–45% nickel, 23–26% chromium, 0.6–0.9% manganese, 1–1.7% silicon, 0.2–0.6% titanium, 0.25–0.55% aluminum, 1.3–1.7% molybdenum, 0.25–0.6% niobium, 0.15–0.45% tantalum, 0–0.2% tungsten, 0.001–0.005% boron, 0.01–0.03% zirconium strengthening phases consisting essentially of at least one phase selected from the group consisting of $M_6C$, $M_7C_3$ and MC carbides, and balance iron with trace commercial impurities.

2. The alloy according to claim 1 including about 0.082–0.114%C, 0.015–0.29%Mn, 25.77–29.93%Fe, 0.0006–0.001%S, 1.51–1.97%Si, 41.56–44.16%Ni, 23.63–25.22%Cr, 0.055–0.13%Al, 0.41–0.5%Ti, 0.0023–0.05%Co, 1.43–1.54%Mo, 0.0024–0.001%B, 0.370–0.396%Nb, 0.0001–0.014%P, 0.21–0.25%Ta, and 0.003–0.11%W.

3. The alloy according to claim 1 including about 0.11%C, 0.02% Mn, 1.8%Si, 0.28% Ti, 0.21% Al, 26.2%Cr, 1.5%Mo, 0.4%Nb, 0.22%Ta, 0.009Zr, 44%Ni, and balance iron.

4. The alloy according to claim 1 including about 0.082%C, 0.015%Mn, 1.51%Si, 44.16%Ni, 25.22%Cr, 0.45%Ti, 0.13%Al, 1.54%Mo, 0.39%Nb, 0.21%Ta, 0.0037%B and balance iron.

5. The alloy according to claim 1 including about 0.061%C, 0.295%Mn, 1.53%Si, 44.13%Ni, 25.18%Cr, 0.46%Ti, 0.12%Al, 1.54%Mo, 0.391%Nb, 0.23%Ta, 0.0026%B, and balance Fe.

6. The alloy according to claim 1 including about 0.104%C, 0.301%Mn, 1.96%Si, 43.96%Ni, 25.12%Cr, 0.44%Ti, 0.12%Al, 1.53%Mo, 0.387%Nb, 0.23%Ta, 0.003%W, 0.0029%B, and balance Fe.

7. The alloy according to claim 1 including about 0.06–0.11%C, 0.02–0.3Mn, 1.51–1.96%Si, 0.28–0.46%Ti, 0.12–0.21%Al, 43.96–44.16%Ni, 25.12–26.2%Cr, 1.5–1.53%Mo, 0.387–0.4%Nb, 0.21–0.23%Ta, 0.0026–0.005%B, and balance Fe.

8. A method for strengthening a nickel-base alloy by the formation of strengthening phases consisting essentially of at least one phase selected from the group consisting of $M_6C$, $M_7C_3$ and MC carbides therein, the process comprising:

a) providing an alloy including about, 0.08–0.11% carbon, 41–45% nickel, 23–26% chromium, 0.6–0.9% manganene, 1–1.7% silicon, 0.2–0.6% titanium, 0.25–0.55% aluminum, 1.3–1.7% molybdenum, 0.25–0.6% niobium, 0.15–0.45% tantalum, 0–0.2% tungsten, 0.001–0.005% boron, 0.01–0.03% zirconium, and the balance essentially iron with trace commercial impurities; and b) exposing the alloy to a carbon containing environment c) at a temperature of at least about 900° C. to encourage strengthening.

9. The process according to claim 8 wherein the alloy is formed into a tube.

10. The process according to claim 8 wherein the alloy is disposed in a ethylene pyrolysis cracking furnace.

11. The process according to claim 8 wherein the alloy is strengthened under service conditions.

12. The process according to claim 8 wherein the alloy is employed for steam methane reforming.

13. The process according to claim 8 wherein the alloy is given a final anneal at a temperature of about 1177° C. to 1232° C. for at least about twenty minutes.

14. The process according to claim 8 wherein the ASTM grain size is about 2.

15. The process according to claim 8 wherein the alloy is melted, AOD refined and cooled to form ingots.

16. The process according to claim 8 wherein the alloy is formed into a finned tube.

* * * * *